US008469211B2

(12) United States Patent
Meng et al.

(10) Patent No.: US 8,469,211 B2
(45) Date of Patent: Jun. 25, 2013

(54) COUPLER DRAFT GEAR, DOUBLE-SIDE OPERATING COUPLER AND LOWER LOCKPIN ROTATION SHAFT ASSEMBLY

(75) Inventors: Qingmin Meng, Qiqihar (CN); Yan Jiang, Qiqihar (CN); Yuebin Yu, Qiqihar (CN); Yingjun Cui, Qiqihar (CN); Long Chen, Qiqihar (CN); Junsong Wang, Qiqihar (CN); Hongji Sun, Qiqihar (CN)

(73) Assignees: Qiqihar Railway Rolling Stock Co., Ltd. (CN); Mudanjiang Jinyuan Coupler and Draft Gear Manufacturing Co., Ltd. (CN)

( * ) Notice: Subject to any disclaimer, the term of this patent is extended or adjusted under 35 U.S.C. 154(b) by 353 days.

(21) Appl. No.: 12/810,885

(22) PCT Filed: Jul. 22, 2009

(86) PCT No.: PCT/CN2009/072861
§ 371 (c)(1),
(2), (4) Date: Jun. 28, 2010

(87) PCT Pub. No.: WO2010/083673
PCT Pub. Date: Jul. 29, 2010

(65) Prior Publication Data

US 2011/0049078 A1 Mar. 3, 2011

(30) Foreign Application Priority Data

Jan. 22, 2009 (CN) ..... 2009 1 0006055

(51) Int. Cl.
*B61G 3/00* (2006.01)

(52) U.S. Cl.
USPC ..... 213/211; 213/166

(58) Field of Classification Search
USPC ..... 213/159, 162, 171, 211, 212, 161, 213/169, 170, 109
See application file for complete search history.

(56) References Cited

U.S. PATENT DOCUMENTS 1,246,222 A * 11/1917 Bazeley ..... 213/162
1,815,704 A * 7/1931 Cooke ..... 213/171

(Continued)

FOREIGN PATENT DOCUMENTS

CN 200977926 11/2007
CN 101475015 7/2009

(Continued)

OTHER PUBLICATIONS

International Patent Application No. PCT/CN2009/072861: International Search Report dated Nov. 5, 2009, 10 pages.

(Continued)

*Primary Examiner* — Jason C Smith
(74) *Attorney, Agent, or Firm* — Woodcock Washburn LLP

(57) ABSTRACT

A lower lockpin rotation shaft assembly includes a lower lockpin rotation shaft body, an outer end portion thereof having a first coupler lifting bar hole, an intermediate portion thereof having a connecting key; and a lower lockpin rotation shaft bush, an outer end portion of the lower lockpin rotation shaft bush having a second coupler lifting bar hole, and an inner end portion of the lower lockpin rotation shaft bush being operatively connected to an inner end portion of the lower lockpin rotation shaft body. Further, the present invention further provides a double-side operating coupler and a coupler draft gear having the above lower lockpin rotation shaft assembly. The coupler draft gear further includes two coupler lifting bars and two coupler lifting bar seats. Each of the coupler lifting bars is inserted in a keyhole-shaped through hole of corresponding coupler lifting bar seat, and the coupler lifting bar has a restrained segment at a fitted portion of the coupler lifting bar with the coupler lifting bar seat. Coupler heads of the two coupler lifting bar are inserted through the keyhole-shaped through holes of the two coupler lifting bar seats and then coupled with the first coupler lifting bar hole and the second coupler lifting bar hole of the double-side operating coupler. There is a gap between the restrained segment of each coupler lifting bar and walls of the rectangular hole of the keyhole-shaped through hole.

6 Claims, 8 Drawing Sheets

U.S. PATENT DOCUMENTS

| | | | | | |
|---|---|---|---|---|---|
| 1,932,719 | A | * | 10/1933 | Bazeley | 213/169 |
| 1,986,440 | A | * | 1/1935 | Kinne | 213/127 |
| 2,083,422 | A | * | 6/1937 | Bazeley | 213/167 |
| 2,803,354 | A | * | 8/1957 | Sale | 213/168 |
| 3,029,956 | A | * | 4/1962 | De Penti | 213/147 |
| 3,029,965 | A | * | 4/1962 | Maier | 220/3.8 |
| 3,102,644 | A | * | 9/1963 | Cope | 213/166 |
| 3,227,289 | A | * | 1/1966 | Cseri | 213/219 |
| 3,438,513 | A | * | 4/1969 | Frageman et al. | 213/166 |
| 3,491,899 | A | * | 1/1970 | Cope | 213/159 |
| 3,762,575 | A | * | 10/1973 | Cseri | 213/166 |
| 4,398,641 | A | * | 8/1983 | Klimowicz | 213/109 |
| 5,833,086 | A | * | 11/1998 | Kaufhold | 213/148 |
| 5,927,522 | A | * | 7/1999 | Carifa | 213/166 |
| 6,139,261 | A | * | 10/2000 | Bishop et al. | 415/148 |
| 6,769,889 | B1 | * | 8/2004 | Raney et al. | 418/171 |
| 2004/0120615 | A1 | * | 6/2004 | Chase | 384/42 |
| 2011/0049078 | A1 | * | 3/2011 | Meng et al. | 213/170 |
| 2011/0073555 | A1 | * | 3/2011 | Cui et al. | 213/148 |
| 2011/0266243 | A1 | * | 11/2011 | Jiang et al. | 213/211 |

FOREIGN PATENT DOCUMENTS

| | | |
|---|---|---|
| GB | 809185 | 2/1959 |
| GB | 993791 | 6/1965 |

OTHER PUBLICATIONS

Australian Patent Application No. 2009324256: Notice of Acceptance dated Jul. 6, 2011, 4 pages.

* cited by examiner

COUPLER DRAFT GEAR, DOUBLE-SIDE OPERATING COUPLER AND LOWER LOCKPIN ROTATION SHAFT ASSEMBLY

CROSS-REFERENCE TO RELATED APPLICATIONS

This application is the U.S. National Stage of International Application No. PCT/CN2009/072861 filed Jul. 22, 2009, which claims priority under 35 USC 119 (A-D) of Chinese Application No. 200910006055.2, filed Jan. 22, 2009, the disclosures of which are incorporated herein by reference in their entirety.

FIELD OF THE INVENTION

The present invention relates to coupling technology between carriages of railcar, and more specifically to a coupler draft gear, a double-side operating coupler and a lower lockpin rotation shaft assembly.

BACKGROUND OF THE INVENTION

The coupler is one of important parts of a railcar, and has a standard connecting contour. It is mainly used to ensure the coupling between cars and achieve operations of train marshalling and car drafting.

Typically, conventional train coupler will be operated in three operating states, i.e., locked state, unlock state and full open state. When a coupler is in the locked state, a coupler knuckle lock stops a coupler knuckle from being opened, and coupled cars cannot be separated spontaneously. For 17-type coupler, when rotating the coupler lifting bar, the coupler knuckle lock is lifted to an unlock position by the lower lockpin rotation shaft and a lower lockpin mechanism which are coupled with the coupler lifting bar, and then the coupler is switched into the unlock state. At this time, the coupler knuckle will be opened under external force and separate cars. When the coupler lifting bar is lifted to the upmost position, the coupler knuckle is pushed to a full open position by the coupler knuckle lock. At this time, the coupler is switched into the full open state, and adjacent cars will be coupled. Two cars may be coupled with each other spontaneously when they are colliding, so as to achieve the train marshalling. When separating the trains, an operator standing outside the end of the car manipulate a coupler lifting bar to unlock coupled couplers, thereby separating two coupled cars. In this way, it can not only improve the operating efficiency of train marshalling, but also ensure the safety of operator. Referring to FIG. 1, a schematic view of operating state of a conventional 17-type coupler is shown.

In hump shunting operation (referring to FIGS. 2*a* and 2*b*), an operator standing at the side of railroad line having signal display manipulates a coupler lifting bar such that a rear coupler of a rolling car is in the unlock state. During rolling, on one hand, a speed reducer in the railroad line will decrease the rolling speed of the rolling car so as to ensure that the rolling car will not exceed an allowable speed when coupling; and on the other hand, the rolling car will collide with a standing car when coupling. Thus, under the inertia force of the rolling car, it is possible that the coupler knuckle of the rear coupler of the rolling car may pivot on a coupler knuckle pin in a locked direction. That is, the rear coupler may be in a non-full open position or the locked position, while a front coupler of a subsequent rolling car is in the locked position at this moment. Therefore, after the subsequent rolling car rolls downwardly, the two cars can not be successfully coupled together. Accordingly, the success ratio of coupling in marshalling is decreased, which may affect the operating efficiency in marshalling and also may directly or indirectly affect the safety of operator in operating.

In view of the above disadvantages, there is an urgent requirement to develop a mechanism or member which unlocks a coupler from both sides thereof by means of coupler lifting bars, so as to be applicable to many operating conditions such as hump shunting.

SUMMARY OF THE INVENTION

In view of the above disadvantages, the technical problem to be solved by the present invention is to provide a lower lockpin rotation shaft assembly which is applicable to a double-side operating coupler, so as to carry out coupler operations from both sides of car. Based on this, the present invention further provides a double-side operating coupler and a coupler draft gear having the lower lockpin rotation shaft assembly.

The lower lockpin rotation shaft assembly according to the present invention includes a lower lockpin rotation shaft body, an outer end portion thereof having a first coupler lifting bar hole, an intermediate portion thereof having a connecting key, wherein the lower lockpin rotation shaft assembly further comprises a lower lockpin rotation shaft bush, an outer end portion of the lower lockpin rotation shaft bush has a second coupler lifting bar hole, and an inner end portion of the lower lockpin rotation shaft bush is operatively connected to an inner end portion of the lower lockpin rotation shaft body.

Preferably, the first coupler lifting bar hole and the second coupler lifting bar hole are opened in an identical direction.

Preferably, the inner end portion of the lower lockpin rotation shaft body has a first radial through hole; the inner end portion of the lower lockpin rotation shaft bush has a second radial through hole; after the inner end portion of the lower lockpin rotation shaft bush is capped on the inner end portion of the lower lockpin rotation shaft body, central lines of the first radial through hole and the second radial through hole coincide with each other, and a rivet or threaded fastener is provided in the through holes such that the lower lockpin rotation shaft body is fixedly connect to the lower lockpin rotation shaft bush.

The double-side operating coupler according to the present invention includes a coupler body, a coupler knuckle, a knuckle thrower, a coupler knuckle pin, a coupler knuckle lock, a lower lockpin assembly and a lower lockpin rotation shaft. The lower lockpin rotation shaft adopts the lower lockpin rotation shaft assembly as described above. The inner end portion of the lower lockpin rotation shaft body protrudes through a pin hole in a lower cavity of the coupler body and then is fixedly connected to the lower lockpin rotation shaft bush.

The coupler draft gear according to the present invention includes a coupler, coupler lifting bar coupled with coupler lifting bar hole of the coupler, and coupler lifting bar seat cooperated with the coupler lifting bar. The coupler lifting bar seat has a keyhole-shaped through hole; the coupler lifting bar is inserted in the keyhole-shaped through hole of the coupler lifting bar seat, the coupler lifting bar has a restrained segment at a fitted portion of the coupler lifting bar with the coupler lifting bar seat, the restrained segment of the coupler lifting bar has a rectangular cross-section matching with a rectangular cross-section at a lower portion of the keyhole-shaped through hole. The coupler adopts the double-side operating coupler as described above. It is provided two coupler lifting bar seats, which are fixedly disposed on a car body at both sides of the coupler, respectively. It is provided two coupler lifting bars, and coupler heads of the two coupler lifting bars are inserted through the keyhole-shaped through holes of the two coupler lifting bar seats and then coupled with the first coupler lifting bar hole and the second coupler lifting bar hole of the double-side operating coupler. There is a gap between the restrained segment of the coupler lifting bar and walls of the rectangular hole of the keyhole-shaped through hole of the coupler lifting bar seat. The fit between the keyhole-shaped hole in the coupler lifting bar seat and the restrained segment of the coupler lifting bar may prevent the coupler lifting bar from swaying back and forth when the train vibrates in longitudinal direction, thus avoiding the fact that the coupler is unlocked due to mistake operation, leading to a train separating accident.

Preferably, the ratio of a width to a height of a cross-section of the restrained segment of the coupler lifting bar is 2/5 to 3/4; and the ratio of the gap between the restrained segment of the coupler lifting bar and the walls of the rectangular hole of the keyhole-shaped through hole to the width of the cross-section of restrained segment of the coupler lifting bar is 1/10 to 1/8.

Preferably, the ratio of the width to the height of the cross-section of the restrained segment of the coupler lifting bar is 1/2; and the ratio of the gap between the restrained segment of the coupler lifting bar and the walls of the rectangular hole of the keyhole-shaped through hole to the width of the cross-section of restrained segment of the coupler lifting bar is 1/9.

Preferably, the coupler draft gear further comprises two tension springs disposed at both sides of the coupler, respectively, one end of each of the tension springs is fixedly connected to the car body, and the other end thereof is fixedly connected to corresponding coupler lifting bar.

The lower lockpin rotation shaft assembly according to the present invention includes two main components, i.e., a lower lockpin rotation shaft body and a lower lockpin rotation shaft bush. The structure and functions of the lower lockpin rotation shaft body are basically same as that of lower lockpin rotation shaft in the prior art. The outer end portion of the lower lockpin rotation shaft body has a coupler lifting bar hole, i.e., the first coupler lifting bar hole. The outer end portion of the lower lockpin rotation shaft bush has a coupler lifting bar hole, i.e., the second coupler lifting bar hole. During assembling, the inner end portion of the lower lockpin rotation shaft body protrudes through a hole in the coupler body and then is fixedly connected to the inner end portion of the lower lockpin rotation shaft bush. The first coupler lifting bar hole and the second coupler lifting bar hole are located at both sides of the coupler body, respectively, such that the operator standing any side of car body may easily and reliably perform the unlock operation to front and rear couplers at connecting end of two cars.

In hump shunting operation, the operator standing at the side of railroad line having signal display manipulates coupler lifting bars of front and rear couplers. During rolling, even if the rear coupler of rolling car is blocked to be in a non-full open position or locked position, it is possible to ensure that the subsequent rolling car is successfully coupled with the previous rolling car after the subsequent rolling car rolling downwardly because the front coupler of the subsequent rolling car is in a full open position. Therefore, the success ratio of coupling in marshalling is ensured.

In the preferred embodiment of the lower lockpin rotation shaft assembly according to the present invention, the first coupler lifting bar hole and the second coupler lifting bar hole are opened in an identical direction. Thus, when performing an unlock operation at both sides of car, the rotating angles of them are the same, so as to improve the interchangeability of product, which is applicable to mass production.

In the coupler draft gear according to the present invention, the coupler lifting bars and coupler lifting bar seats are disposed at both sides of the coupler, respectively. During assembling, the coupler heads of the two coupler lifting bars are inserted through the keyhole-shaped through holes of the coupler lifting bar seats, and then are coupled with the coupler lifting bar holes at both sides of the lower lockpin rotation shaft assembly, respectively. When unlocking the coupler, a coupler lifting bar at any side of the lower lockpin rotation shaft body is manipulated; after the restrained segment thereof is lifted into the circular hole of the keyhole-shaped hole, the coupler lifting bar is rotated, and the lower lockpin rotation shaft assembly is rotated with the lower lockpin rotation shaft body, as a result, the coupler is unlocked at this moment. Meanwhile, the coupler head of the coupler lifting bar is coupled with the coupler lifting bar hole. When this coupler lifting bar is lifted, the coupler head of the other coupler lifting bar is lifted with this coupler lifting bar, but doesn't rotate. In addition, since there is a gap between the restrained segment of the coupler lifting bar and the walls of the rectangular hole of the keyhole-shaped through hole, when this coupler lifting bar is rotated, the other coupler lifting bar may sway in the rectangular hole of the coupler lifting bar hole in the lower lockpin rotation shaft bush. Similarly, the coupler lifting bar at the side of the lower lockpin rotation shaft bush is manipulated; after the lower lockpin rotation shaft assembly is rotated with the lower lockpin rotation shaft bush, the coupler is unlocked, while coupler lifting bar at the opposite side doesn't rotate in the coupler lifting bar hole of the lower lockpin rotation shaft.

Based on the above description, when any coupler lifting bar according to the present invention is manipulated to unlock the coupler, the problem of interference with each other will not occur, and the use and performance of the coupler isn't affected. Thus, the coupler of the present invention may be operated reliably. Furthermore, the coupler lifting bar seats having keyhole-shaped hole are provided for the coupler lifting bars at both sides to achieve a better coupling reliability between the couplers.

In the preferred embodiment of the double-side operating coupler of the present invention, a tension spring is provided for each coupler lifting bar. The tension spring is disposed between the coupler lifting bar and the car body. When any coupler lifting bar is rotated to unlock the coupler, corresponding tension spring is stretched and deformed and thus stores the energy of deformation. After an unlock operation, the coupler lifting bar is quickly returned by the tension spring, so as to come into pre-unlock ready state, which further improves the operability of the present invention.

BRIEF DESCRIPTION OF THE DRAWINGS

FIG. 2 is a schematic view of hump shunting operation; in which

REFERENCE NUMERALS IN FIGS. 3-8

| | |
|---|---|
| 11-lower lockpin rotation shaft body, | 111-first coupler lifting bar hole, |
| 112-connecting key, | 113-shaft shoulder, |
| 114-first radial through hole, | 12-lower lockpin rotation shaft bush, |
| 121-second coupler lifting bar hole, | 122-second radial through hole, |
| 123-bush hole, | 2-coupler body, |
| 3-coupler knuckle, | 10-double-side operating coupler, |
| 20-coupler lifting bar, | 21-restrained segment, |
| 30-coupler lifting bar seat, | 31-keyhole-shaped through hole, |
| 40-car body, | 50-tension spring, |

DETAILED DESCRIPTION OF THE INVENTION

The object of the present invention is to provide a lower lockpin rotation shaft assembly with two coupler lifting bar hole which are respectively located at two sides of a coupler body after assembling with the coupler body so as to facilitate engaging with coupler lifting bars at two sides, which may achieve a reliable coupler unlock operation from two sides, so as to be applicable to many operating conditions such as hump shunting.

Hereinafter, the present embodiment will be specifically described with reference to the drawings in the specification.

Figure 1:
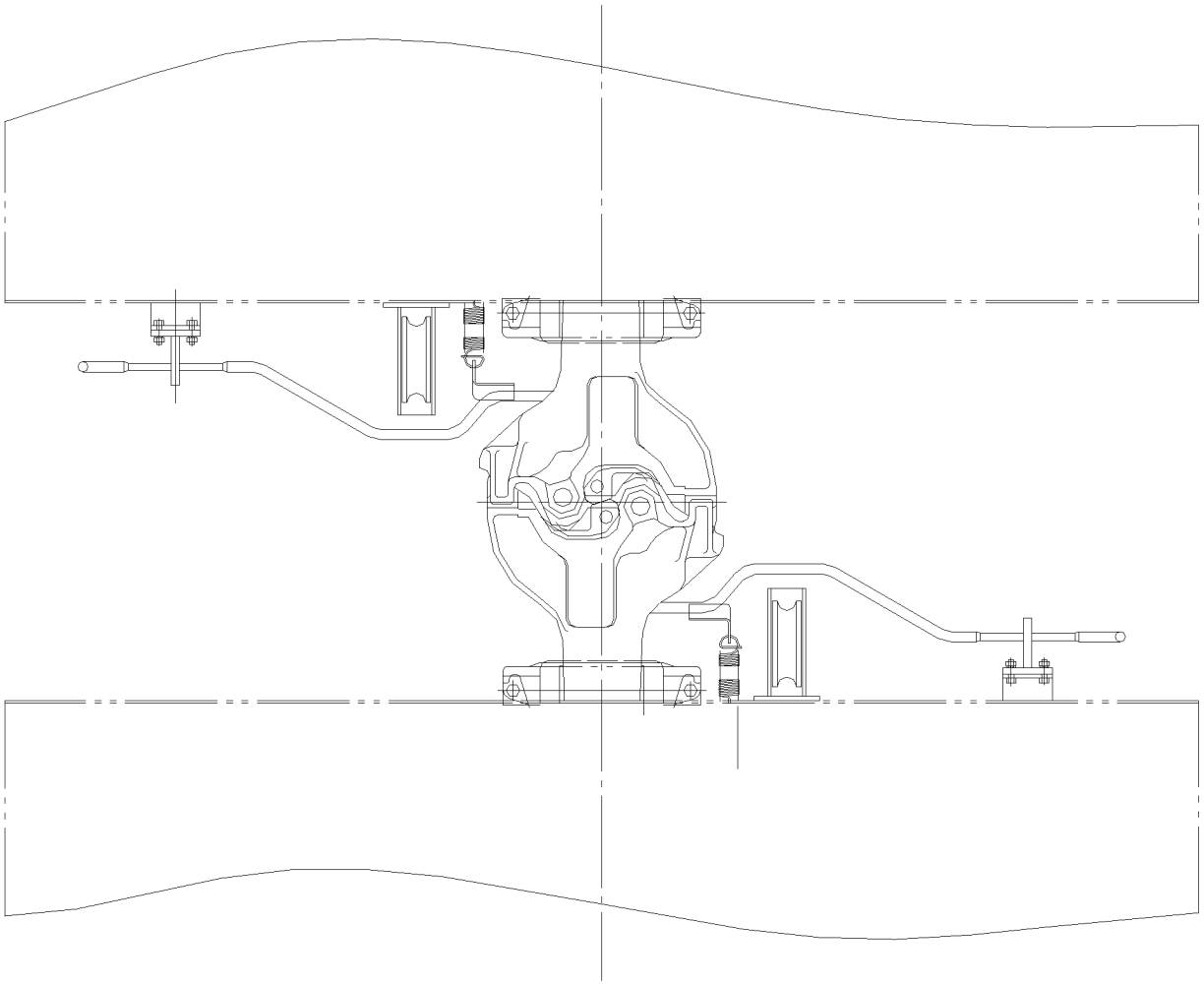
FIG. 1 is a schematic view of operating state of a conventional 17-type coupler.
Figure 2A:
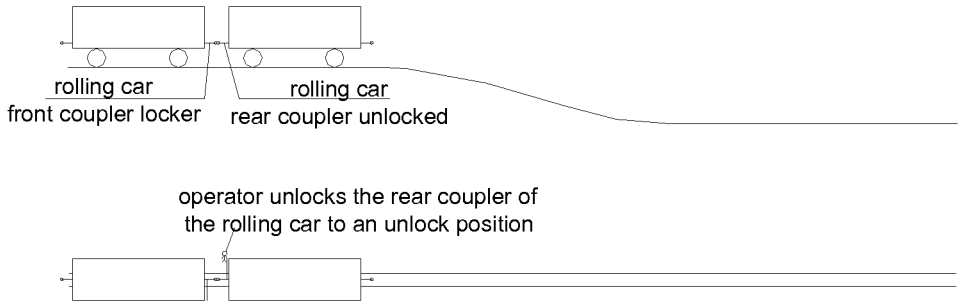
FIG. 2*a* shows a operating state before rolling and FIG. 2*b* shows a operating state after rolling.
Figure 2B:
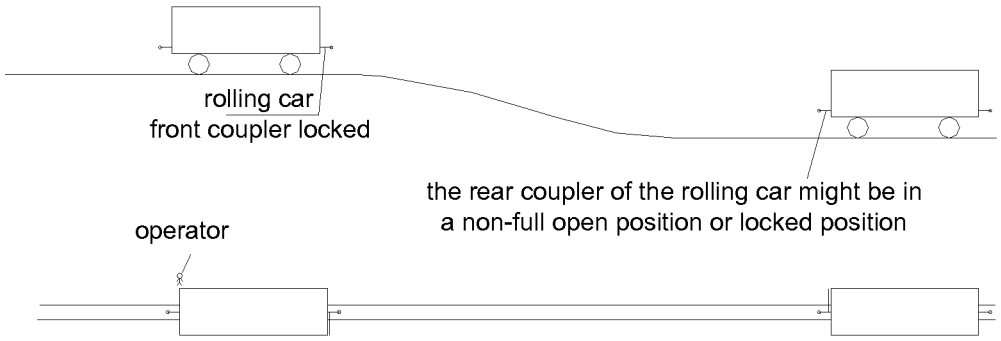
Figure 3:
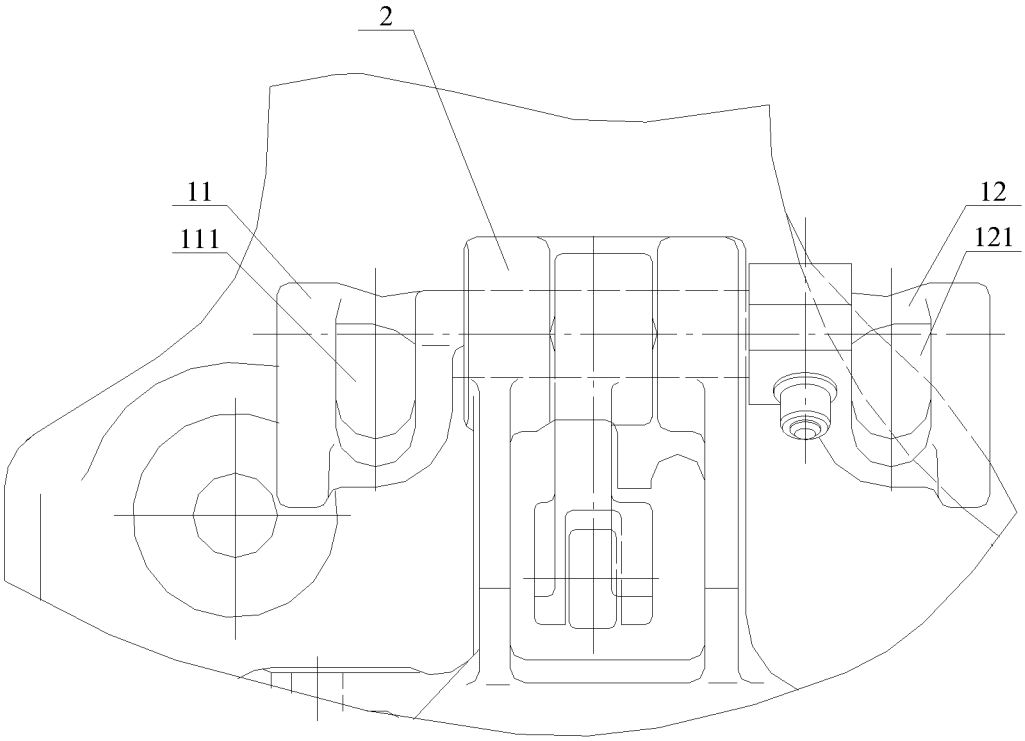
FIG. 3 is a schematic structural view after assembling the lower lockpin rotation shaft assembly and the coupler body of the present invention together.

Referring to FIG. 3, a schematic structural view after assembling the lower lockpin rotation shaft assembly and the coupler body of the present invention together is shown.

As shown in FIG. 3, the lower lockpin rotation shaft assembly mainly consists of a lower lockpin rotation shaft body 11 and a lower lockpin rotation shaft bush 12. In order to explain the structure of the lower lockpin rotation shaft body 11 and the lower lockpin rotation shaft bush 12 and the engagement relationship therebetween in detail, please also refer to FIGS. 4 and 5. Three views of the lower lockpin rotation shaft body are shown in FIG. 4, and three views of the lower lockpin rotation shaft bush are shown in FIG. 5.

Figure 4C:
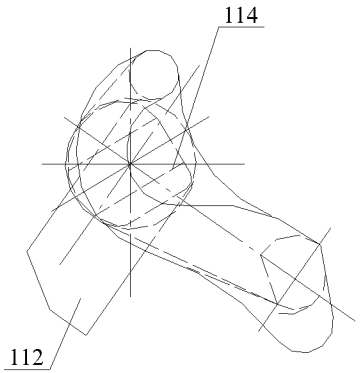
FIG. 4*a*, FIG. 4*b* and FIG. 4*c* show the front view, the top view and the left view of the lower lockpin rotation shaft body, respectively.
Figure 4A:
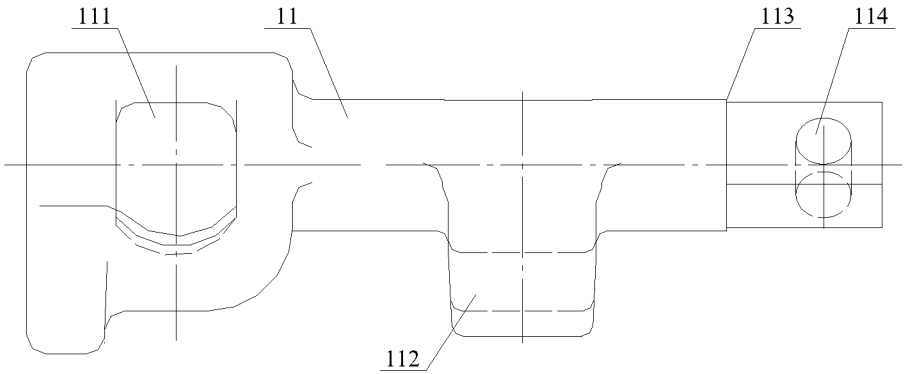
Figure 4B:
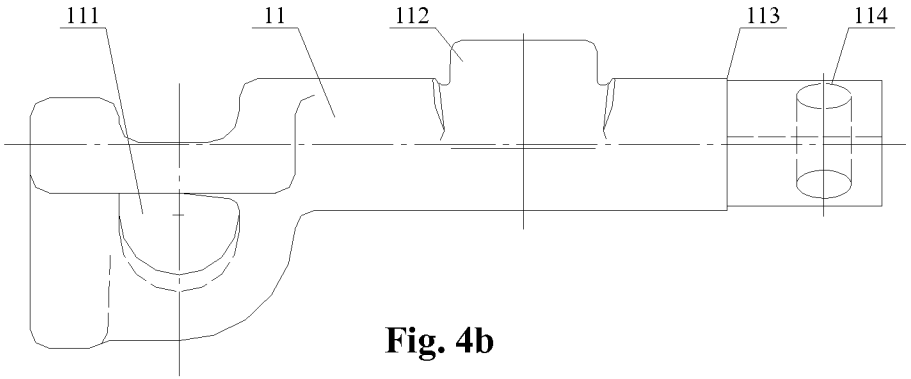

As shown in FIGS. 4*a*, 4*b* and 4*c*, the outer end portion of the lower lockpin rotation shaft body 11 has a first coupler lifting bar hole 111 configured to couple a coupler head of a coupler lifting bar. The intermediate portion of the lower lockpin rotation shaft body 11 has a connecting key 112 configured to be interposed between two ribs of the lower cavity of the coupler body. The connecting key 112 performs stop function and is connected to a lower lockpin rod, thereby guiding the vibration and displacement direction of the lower lockpin rod.

Actually, the functions of the lower lockpin rotation shaft body 11 in the present technical solution are the same as that of the lower lockpin rotation shaft of the conventional 17-type coupler. During assembling, the lower lockpin rotation shaft body 11 is inserted through a pin hole of the coupler body until the connecting key 112 are positioned between the two ribs of the lower cavity of the coupler body. Then, the lower lockpin rotation shaft body is rotated by about 90° in rearward direction. After coupling with the lower lockpin, the lower lockpin rotation shaft body 11 protrudes from the coupler body, and is fixedly connected to the lower lockpin rotation shaft bush. This engagement relationship is not the inventive point of the application and may be achieved by the ordinary skilled in the art based on conventional technology, and thus the description thereof will be omitted herein. As shown in FIG. 4, in this embodiment, the inner end portion of the lower lockpin rotation shaft body 11 has a shaft shoulder 113 engaged with the lower lockpin rotation shaft bush 12.

Figure 5A:
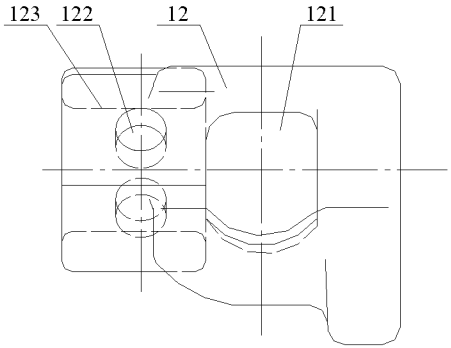
FIG. 5*a*, FIG. 5*b* and FIG. 5*c* show the front view, the top view and the left view of the lower lockpin rotation shaft bush, respectively.
Figure 5B:
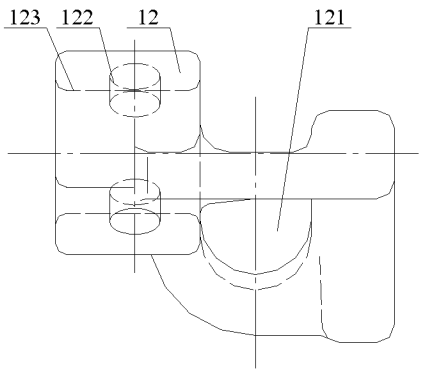
Figure 5C:
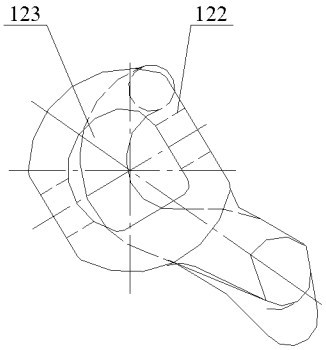

As shown in FIGS. 5*a*, 5*b* and 5*c*, the outer end portion of the lower lockpin rotation shaft bush 12 has a second coupler lifting bar hole 121, and the inner end portion thereof is operatively connected to the inner end portion of the lower lockpin rotation shaft body 11. It is appreciated that the lower lockpin rotation shaft bush 12 and the lower lockpin rotation shaft body 11 are fixedly connected together after assembling in order to meet requirements in use.

Specifically, as shown in FIG. 4, the inner end portion of the lower lockpin rotation shaft body 11 has a first radial through hole 114. As shown in FIG. 5, the inner end portion of the lower lockpin rotation shaft bush 12 has a second radial through hole 122. During assembling, the bush hole 123 in the inner end portion of the lower lockpin rotation shaft bush 12 is capped on the inner end portion of the lower lockpin rotation shaft body 11, and abuts against the shaft shoulder 113 of the lower lockpin rotation shaft body 11, so as to limit the relative axial position between the lower lockpin rotation shaft bush 12 and the lower lockpin rotation shaft body 11. When the central lines of the first radial through hole 114 and the second radial through hole 122 coincide with each other, a rivet or threaded fastener may be inserted into the through holes to fixedly connect the lower lockpin rotation shaft body and the lower lockpin rotation shaft bush.

Actually, the engagement structure between the lower lockpin rotation shaft body 11 and the lower lockpin rotation shaft bush 12 is not limit to the installing structure shown in figures. Instead, the fixed connection relationship therebetween may be implemented by adopting many processes such as welding. However, in order to ensure car safe running, the coupler will be examined and repaired or maintained regularly. As can be seen, the above riveting or thread connection is easily disassembled and assembled, which facilitates the release of the fixed connection relationship therebetween, reduces operating period of examination and repair or maintenance, and thus becomes the best connection mode.

As shown in FIGS. 4 and 5, the first coupler lifting bar hole 111 and the second coupler lifting bar hole 121 are opened in the identical direction. Thus, when performing an unlock operation at both sides of car, their rotating angles are the same, so as to improve the interchangeability of product, which is applicable to mass production. The operator may manipulate same-side coupler lifting bars of two couplers at connection ends of two cars at the same time. Since rotating angles of the coupler lifting bars are the same, it facilitates simultaneous operation.

It is particularly noted that, the terms "outer" and "inner" in this specification are defined on the basis of position relationship after assembling the lower lockpin rotation shaft body 11 and the lower lockpin rotation shaft bush 12, that is, the side of the lower lockpin rotation shaft body 11 and the lower lockpin rotation shaft bush 12 provided with the coupler lifting bar hole is referred to as "outer side", while the engagement side of them is referred to as "inner side".

Figure 6:
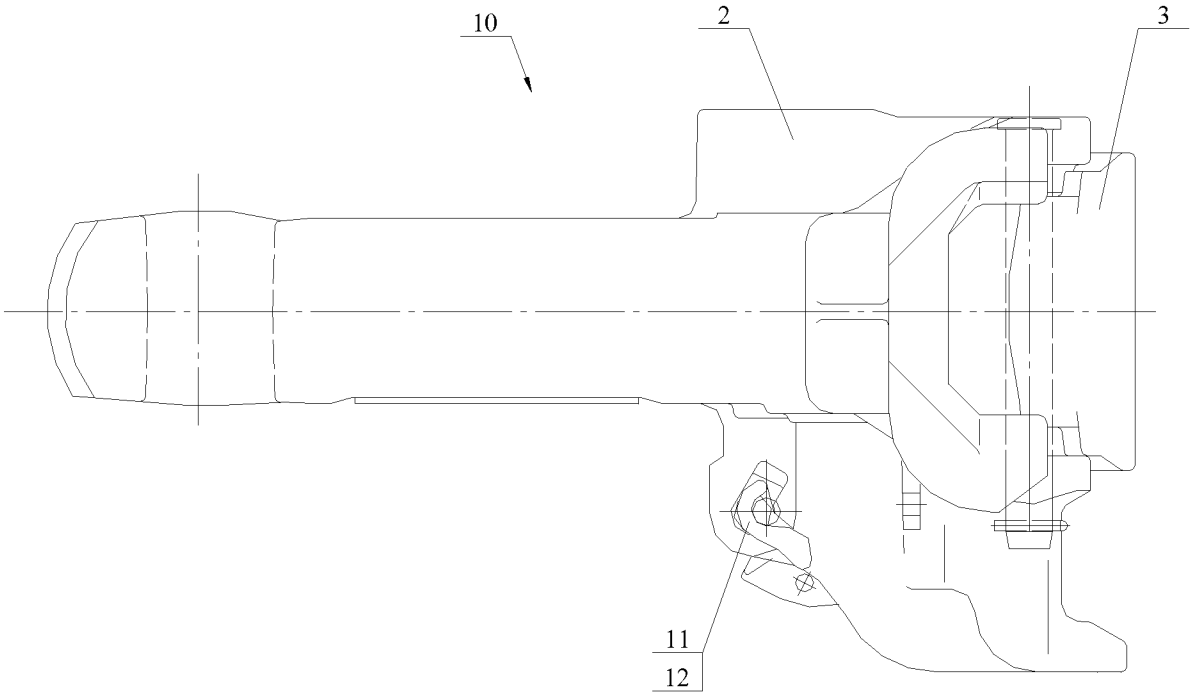
FIG. 6 is a schematic overall structural view of the double-side operating coupler according to the present invention.

Referring to FIG. 6, a schematic overall structural view of the double-side operating coupler is shown.

As shown in FIG. 6, the double-side operating coupler according to the present invention includes a coupler body 2, a coupler knuckle 3, a knuckle thrower, a coupler knuckle pin, a coupler knuckle lock, the lower lockpin rotation shaft assembly 1 and the lower lockpin assembly. Referring to FIG. 3, the inner end portion of the lower lockpin rotation shaft body 11 protrudes through a pin hole in the lower cavity of the coupler body 2 and then is fixedly connected to the lower lockpin rotation shaft bush 12. It should be noted that the intermediate portion of the lower lockpin rotation shaft body 11 has the connecting key 112, and the connection method between the lower lockpin rotation shaft body 11 and the lower lockpin assembly is the same as the conventional method. Besides, the major structure of the double-side operating coupler according to the present invention is the same as that of the conventional 17-type coupler, and thus the specific description for the inner structure thereof is omitted therein.

Figure 7:
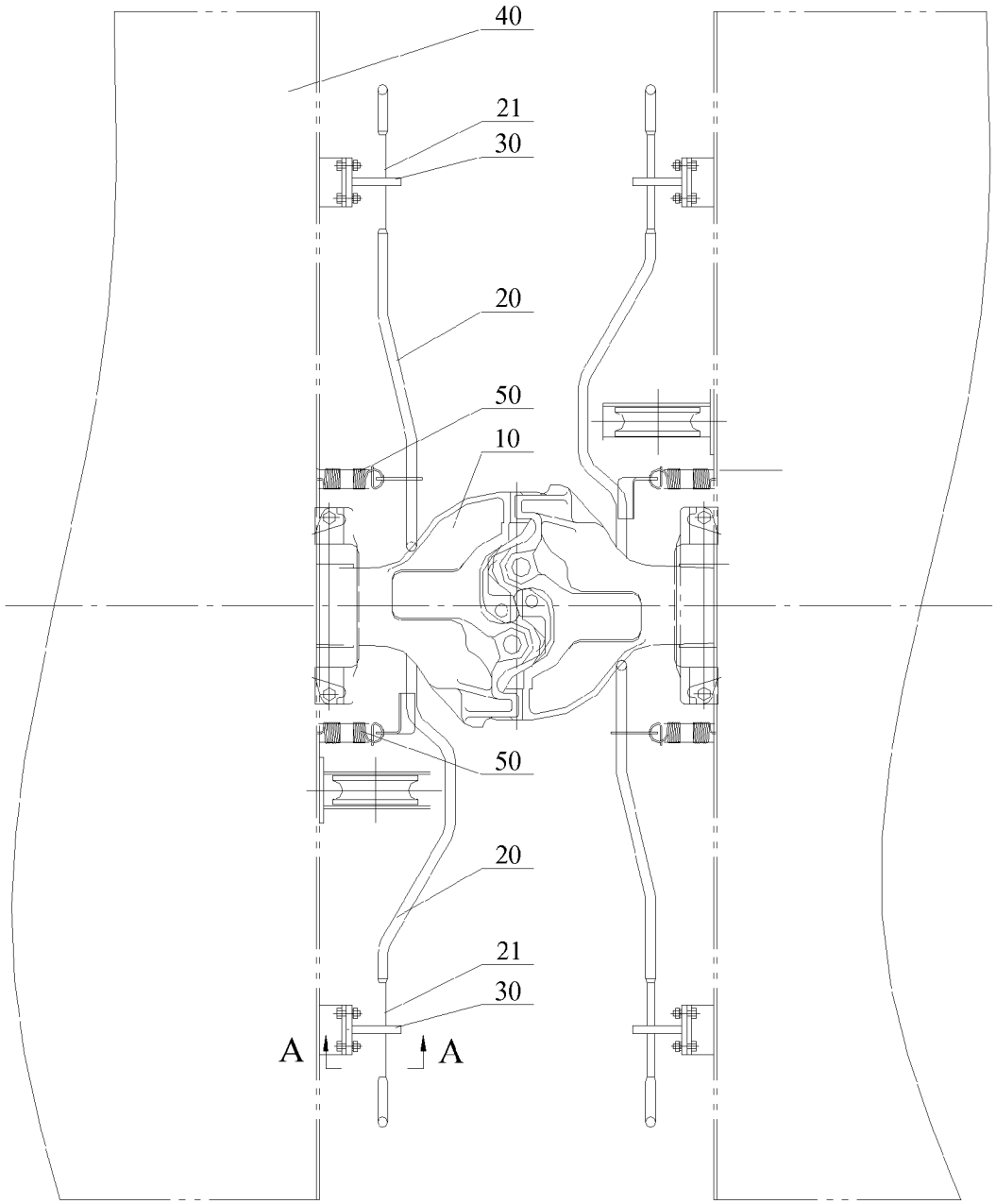
FIG. 7 is a schematic view of the coupler draft gear in operating state according to the present invention.

Referring to FIG. 7, a schematic view of the coupler draft gear in operating state according to the present invention is shown.

As shown in FIG. 7, the coupler draft gear according to the present invention includes a double-side operating coupler 10, coupler lifting bars 20 coupled with coupler lifting bar holes of the coupler 10 respectively and coupler lifting bar seats 30 cooperated with coupler lifting bars 20 respectively.

The structures and engagement relationships of the coupler lifting bar 20 and the coupler lifting bar seat 30 with associated components are basically same as that of the conventional 17-type coupler. Please also refer to FIG. 8, which is a sectional view along line A-A in FIG. 7.

Figure 8:
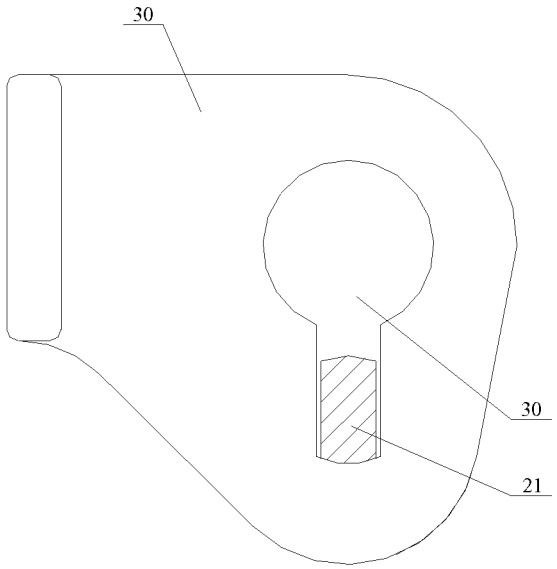
FIG. 8 is a sectional view along line A-A in FIG. 7.

As shown in FIGS. 7 and 8, the coupler lifting bar seat 30 has a keyhole-shaped through hole which consists of a circular hole at the upper portion thereof and a rectangular hole at the lower portion thereof. The coupler lifting bar 20 is inserted through the keyhole-shaped through hole 31 of the coupler lifting bar seat 30, and the coupler lifting bar 20 has a restrained segment 21 at the fitted portion of the coupler lifting bar 20 with the coupler lifting bar seat 30. The restrained segment 21 of the coupler lifting bar has a rectangular cross-section matching with the rectangular cross-section at the lower portion of the keyhole-shaped through hole 31. The number of the coupler lifting bar seat 30 is two, which are fixedly disposed on the car body 40 at both sides of the coupler 10, respectively. The number of the coupler lifting bar 20 is two, and the coupler heads of the two coupler lifting bars 20 are inserted through the keyhole-shaped through holes 31 of the two coupler lifting bar seat, and then are coupled with the first coupler lifting bar hole and the second coupler lifting bar hole (not shown) of the double-side operating coupler 10, respectively. There is a gap between the restrained segment 21 of the coupler lifting bar and the walls of the rectangular hole of the keyhole-shaped through hole 31.

In order to ensure a reliable motion relationship between the coupler lifting bars at both sides, the ratio of the width to the height of the cross-section of the restrained segment of the coupler lifting bar is about 2/5 to 3/4, preferably, 1/2; and the ratio of the gap between the restrained segment of the coupler lifting bar and the walls of the rectangular hole of the keyhole-shaped through hole to the width of the cross-section of restrained segment of the coupler lifting bar is about 1/10 to 1/8, preferably, 1/9.

The coupler lifting bar should return to initial position after performing an unlock operation, so as to get ready for next unlock operation.

In order to ensure that the coupler lifting bar is quickly returned, as shown in FIG. 7, two tension springs 50 are provided at both sides of the coupler 10, respectively. One end of each tension spring 50 is fixedly connected to the car body 40, and the other end thereof is fixedly connected to corresponding coupler lifting bar 20. Thus, when rotating any coupler lifting bar 20 to unlock the coupler, corresponding tension spring 50 is stretched and deformed and thus stores the energy of deformation. After an unlock operation, the coupler lifting bar 20 is quickly returned by the tension spring 50, so as to come into pre-unlock ready state.

During assembling, the coupler is firstly installed on a traction beam; then, the coupler heads of the two coupler lifting bars pass through the keyhole-shaped through holes of the coupler lifting bar seats and are coupled with the coupler lifting bar holes installed at both sides of the lower lockpin rotation shaft assembly of the coupler, respectively; then, each coupler lifting bar seat is assembled with corresponding coupler lifting bar; then, the coupler lifting bar seats are fixed on the end wall of the car body; finally, the tension spring for coupler lifting bar is installed. When unlocking the coupler, the coupler lifting bar at one side is manipulated; after the restrained segment thereof is lifted into the circular hole of the keyhole-shaped hole, the coupler lifting bar is rotated, and the lower lockpin rotation shaft assembly is rotated with the coupler lifting bar; as a result, the coupler is unlocked at this moment. Meanwhile, the coupler head of the coupler lifting bar is coupled with the coupler lifting bar hole. When the coupler lifting bar at one side is lifted, the coupler head of the coupler lifting bar at the other side is lifted with this coupler lifting bar, but doesn't rotate. In addition, since there is a gap between the restrained segment of the coupler lifting bar and the walls of the rectangular hole of the keyhole-shaped through hole, when the coupler lifting bar at this side is rotated, the coupler lifting bar at the other side may sway in the rectangular hole of the coupler lifting bar hole in the lower lockpin rotation shaft bush.

Based on the above description, when any coupler lifting bar according to the present invention is manipulated to unlock the coupler, the problem of interference with each other will not occur, and thus the coupler of the present invention may be operated reliably. Furthermore, the coupler lifting bar seats having keyhole-shaped hole are provided for the coupler lifting bars at both sides, which may unlock the coupler at both sides respectively without decreasing the coupling reliability of the coupler.

It is to be noted that the technical solutions of the present invention are not only applicable to new manufactured cars, but also applied to improve existing cars. In improvement operation, it is only need to replace a lower lockpin rotation shaft, while the other structures and members and components of the coupler are remained. Therefore, the structure of the coupler according to the present invention is simple and reliable.

The preferred embodiment of the present invention has been described. However, it should be noted that for persons skilled in the art, many improvements and modifications may also be made to the present invention without departing from the principle of the present invention. The improvements and modifications also fall into the protection scope of the present invention.

What is claimed is:

1. A lower lockpin rotation shaft assembly comprising:

a lower lockpin rotation shaft body, an outer end portion thereof having a first coupler lifting bar hole, and an intermediate portion thereof having a connecting key, wherein the lower lockpin rotation shaft assembly further comprises a lower lockpin rotation shaft bush, an outer end portion of the lower lockpin rotation shaft bush has a second coupler lifting bar hole, and an inner end portion of the lower lockpin rotation shaft bush is operatively connected to an inner end portion of the lower lockpin rotation shaft body; and the inner end portion of the lower lockpin rotation shaft body has a first radial through hole, the inner end portion of the lower lockpin rotation shaft bush has a second radial through hole, and after the inner end portion of the lower lockpin rotation shaft bush is capped on the inner end portion of the lower lockpin rotation shaft body, central lines of the first radial through hole and the second radial through hole coincide with each other, further comprising a rivet or threaded fastener that is provided in the through holes such that the lower lockpin rotation shaft body is fixedly connected to the lower lockpin rotation shaft bush.

2. A double-side operating coupler comprising a coupler body, a coupler knuckle, a knuckle thrower, a coupler knuckle pin, a coupler knuckle lock, a lower lockpin assembly and a lower lockpin rotation shaft, wherein the lower lockpin rotation shaft comprises the lower lockpin rotation shaft assembly of claim 1, and wherein the inner end portion of the lower lockpin rotation shaft body protrudes through a pin hole in a lower cavity of the coupler body and then is fixedly connected to the lower lockpin rotation shaft bush.

3. A coupler draft gear comprising a coupler, coupler lifting bar coupled with coupler lifting bar hole of the coupler, and coupler lifting bar seat cooperated with the coupler lifting bar, wherein the coupler lifting bar seat has a keyhole-shaped through hole; the coupler lifting bar is inserted in the keyhole-shaped through hole of the coupler lifting bar seat, the coupler lifting bar has a restrained segment at a fitted portion of the coupler lifting bar with the coupler lifting bar seat, and the restrained segment of the coupler lifting bar has a rectangular cross-section matching with a rectangular cross-section at a lower portion of the keyhole-shaped through hole, wherein the coupler comprises the double-side operating coupler of claim 2;

wherein the coupler is provided with two coupler lifting bar seats that are fixedly disposed on a car body at both sides of the coupler, respectively;

wherein the coupler is provided with two coupler lifting bars, and coupler heads of the two coupler lifting bars are inserted through the keyhole-shaped through holes of the two coupler lifting bar seats and then coupled with the first coupler lifting bar hole and the second coupler lifting bar hole of the double-side operating coupler; and wherein a gap is provided between the restrained segment of the coupler lifting bar and walls of the rectangular hole of the keyhole-shaped through hole of the coupler lifting bar seat.

4. The coupler draft gear according to claim 3, wherein the ratio of a width to a height of a cross-section of the restrained segment of the coupler lifting bar is 2/5 to 3/4; and the ratio of the gap between the restrained segment of the coupler lifting bar and the walls of the rectangular hole of the keyhole-shaped through hole to the width of the cross-section of restrained segment of the coupler lifting bar is 1/10 to 1/8.

5. The coupler draft gear according to claim 4, wherein the ratio of the width to the height of the cross-section of the restrained segment of the coupler lifting bar is 1/2, and wherein the ratio of the gap between the restrained segment of the coupler lifting bar and the walls of the rectangular hole of the keyhole-shaped through hole to the width of the cross-section of restrained segment of the coupler lifting bar is 1/9.

6. The coupler draft gear according to claim 3, further comprising two tension springs disposed at both sides of the coupler, respectively, one end of each of the tension springs is fixedly connected to the car body, and the other end thereof is fixedly connected to corresponding coupler lifting bar.

* * * * *